US009765450B2

(12) United States Patent
Weiser et al.

(10) Patent No.: US 9,765,450 B2
(45) Date of Patent: Sep. 19, 2017

(54) POLYAMIDE FABRIC ENHANCING BODY WARMING

(71) Applicant: NILIT LTD., Migdal Ha'emek (IL)

(72) Inventors: Alon Weiser, Netanya (IL); Abed Alrahman Zuabi, Nazareth (IL); Uri Afek, Kiryat Tivon (IL)

(73) Assignee: Nilit Ltd., Migdal, HaEmek (IL)

( * ) Notice: Subject to any disclaimer, the term of this patent is extended or adjusted under 35 U.S.C. 154(b) by 84 days.

(21) Appl. No.: 14/377,456

(22) PCT Filed: Feb. 10, 2013

(86) PCT No.: PCT/IL2013/050120
§ 371 (c)(1),
(2) Date: Aug. 7, 2014

(87) PCT Pub. No.: WO2013/121417
PCT Pub. Date: Aug. 22, 2013

(65) Prior Publication Data

US 2015/0299904 A1 Oct. 22, 2015

(30) Foreign Application Priority Data

Feb. 13, 2012 (IL) ..... 218083

(51) Int. Cl.

| | |
|---|---|
| ***D01F 6/60*** | (2006.01) |
| ***C08K 3/22*** | (2006.01) |
| ***C08K 3/04*** | (2006.01) |
| ***D03D 15/00*** | (2006.01) |
| ***D04B 1/24*** | (2006.01) |
| ***D01F 1/10*** | (2006.01) |

(52) U.S. Cl.
CPC ..... *D01F 6/60* (2013.01); *C08K 3/04* (2013.01); *C08K 3/22* (2013.01); *D01F 1/10* (2013.01); *D03D 15/00* (2013.01); *D04B 1/24* (2013.01); *C08K 2003/2241* (2013.01); *D10B 2331/02* (2013.01); *D10B 2401/00* (2013.01); *D10B 2401/02* (2013.01); *D10B 2501/00* (2013.01)

(58) Field of Classification Search
CPC ..... C08G 69/40; C08J 5/18; C08J 2367/04; C08L 101/00; C08L 77/00; C08L 67/06; C08L 67/02; C08L 67/00; C08L 2201/06; C08L 67/04; C08L 29/04; C08L 1/12; C08L 2666/02; C08L 2666/14; C08K 5/00; C08K 5/14; C08K 3/04; C08K 3/22; C08K 2003/045; C08K 2003/2241; C01B 31/02; A41B 11/00; D02G 3/02; D01D 5/06; D01D 5/34; D01D 5/36; D06N 3/00; D06N 3/14; D06N 3/12; B32B 27/12; D01F 6/92; D01F 6/90; D01F 2/10; D01F 1/10; D01F 8/14; D01F 2/08; D01F 6/60; D03D 15/00; D04B 1/24; D10B 2331/02; D10B 2401/00; D10B 2401/02; D10B 2501/00; A61L 9/012; B01J 21/063; B01J 35/004; B01J 35/06
USPC ..... 524/321, 386; 424/409, 400, 76.1, 76.8
See application file for complete search history.

(56) References Cited

U.S. PATENT DOCUMENTS

| | | | | |
|---|---|---|---|---|
| 8,069,496 | B2 | 12/2011 | Sesselmann | |
| 2005/0107505 | A1 | 5/2005 | Shinoda et al. | |
| 2008/0194766 | A1 | 8/2008 | Neri et al. | |
| 2009/0100655 | A1 | 4/2009 | Hung et al. | |
| 2011/0034097 | A1 | 2/2011 | Chen et al. | |
| 2011/0142900 | A1* | 6/2011 | Ohta | D01F 8/14 424/409 |

FOREIGN PATENT DOCUMENTS

| | | | |
|---|---|---|---|
| CN | 1140770 | A | 1/1997 |
| CN | 1229153 | A | 9/1999 |
| CN | 1546755 | A | 11/2004 |
| CN | 1658945 | A | 8/2005 |
| CN | 101144217 | A | 3/2008 |
| CN | 101418477 | A | 4/2009 |
| CN | 102131966 | A | 7/2011 |
| CN | 102162170 | A | 8/2011 |
| CN | 102191579 | A | 9/2011 |
| CN | 202064124 | U | 12/2011 |
| CN | 202116925 | U | 1/2012 |
| EP | 1097965 | B1 | 5/2001 |
| EP | 2093314 | A2 | 8/2009 |
| GB | 2303375 | A | 2/1997 |
| WO | WO 03/103815 | A1 | 12/2003 |

OTHER PUBLICATIONS

Chinese First Office Action, Chinese Application No. 201380009131.X, May 6, 2015, 14 pages.
European Search Report, European Application No. 13749047.0, Sep. 23, 2015, 7 pages.
PCT International Search Report, PCT/IL2013/050120, May 13, 2013, 4 pages.
PCT Written Opinion, PCT/IL2013/050120, May 13, 2013, 6 pages.
PCT International Preliminary Report on Patentability, PCT/IL2013/050120, Feb. 27, 2014, 19 pages.
Yang, L., "A Green Revolution in Textiles", Taiwan Panorama, Aug 30, 2011, vol. 36, No. 8, [Online] [Retrieved on May 19, 2013] Retrieved from the Internet<URL:http://www.taiwanpanorama.com/en/show_issue.php?id=201180008069e.txt&table=3 . . . >.
Chinese Third Office Action, Chinese Application No. 201380009131.X, Oct. 24, 2016, 26 pages.

* cited by examiner

*Primary Examiner* — Hai Vo
(74) *Attorney, Agent, or Firm* — Fenwick & West LLP

(57) ABSTRACT

The invention provides a polyamide yarn and fabric for making clothes articles which have deodorizing effect and which enhance warming and drying on the skin of the wearer.

12 Claims, No Drawings

POLYAMIDE FABRIC ENHANCING BODY WARMING

FIELD OF THE INVENTION

The present invention relates to a polyamide yarn and fabric, and to articles made therefrom, which have deodorizing effect and enhance warming and drying on the skin of the wearer.

BACKGROUND OF THE INVENTION

Polyamide yarns are among the most widely used fibers in the textile industry, the world annual production being about four million tons. Polyamide yarns, like Nylon 6 or Nylon 66, are used in both knitting and weaving with high efficiency to form high quality and fashionable garments. The manufacture of the synthetic fibers like polyamides employs a process of melt spinning, during which the molten polymer is extruded at high pressure into a cooler environment where it solidifies into filaments. Single filaments formed in the spin cells combine in a multifilament continuous yarn, which is wound onto bobbins. Numerous factors which affect the process design include the processability of all intermediates during the textile production, equipment wear, general costs, and environmental and safety regards. Among others, into consideration must be taken melt viscosity, reuse of leftovers, dyeability of the intermediates, stability of the intermediates during spinning or knitting, design of the final product, etc. Many additives may be used to adjust physical, chemical, and aesthetic properties of the intermediates and the final products. In the field of polymer yarns, modifications are incessantly sought, which aim not only at improving physical properties like mechanical strength and surface aspect, but also at improving the sensation created by the textile material on the skin of the wearer. However, improving one feature may often lead to a worsening of the other features; for example, when including novel additives, process problems may arise, such as material adherence to the equipment or gas formation. In the complex process, any change effected anywhere between the stage of preparing the polymer and finishing the textile product may lead to unpredictable results. It is an object of the invention to provide a polyamide yarn which will keep warm feeling on the skin of the wearer, which will enable good drying, and which will have deodorizing ability, thus providing to the wearer comfortable feeling in a cold environment. U.S. Pat. No. 8,069,496 describes clothing articles rendered odor-absorbing by incorporating activated carbon. CN202064124U describes a heat-retaining blanket comprising polymer and carbon fiber. It is another object of the invention to provide a fabric which will feel warm and dry on the skin of a wearer exposed to lower external temperatures, the fabric comprising one type of polyamide fiber and one type of carbon powder.

It is further an object of the invention to provide a polyamide yarn which will feel warm on the skin of a wearer exposed to lower external temperatures, the yarn also enabling skin drying and having deodorizing effects.

It is further an object of the invention to provide a process for manufacturing a polyamide yarn which will feel warm on the skin of a wearer exposed to lower external temperatures, the yarn also enabling skin drying and having deodorizing effects, without compromising other physical properties of the polyamide yarn and fabric.

It is a still further object of the invention to provide a process for manufacturing a polyamide fabric which is efficient in maintaining suitable skin temperature in cold environment, while having deodorizing effects and keeping the wearer comfortable.

Other objects and advantages of present invention will appear as description proceeds.

SUMMARY OF THE INVENTION

The present invention provides a yarn for manufacturing a fabric with warm-maintaining and deodorizing properties, the yarn comprising i) polyamide (PA); ii) coffee carbon (CC); and iii) inorganic additive. Said polyamide is preferably Nylon 66. Said CC originates from carbonized coffee husks. Said inorganic additive comprises one or more oxides (MO), essentially metal oxides selected from $TiO_2$, $Al_2O_3$, $ZrO_2$, ZnO, and $SiO_2$. Said yarn preferably comprises PA, CC and MO, wherein said CC is preferably present in an amount of between 0.1% and 2.0%. The preferred yarn of the invention contains one or more inorganic additives in an amount of between 0.05% and 0.5%. Said PA is preferably PA66, whereas said CC preferably constitutes from about 0.3% to about 0.8% of said yarn, and said MO preferably constitutes from about 0.15% to about 0.35% of said yarn. Said MO preferably comprises at least three inorganic additives selected from $TiO_2$, $Al_2O_3$, $ZrO_2$, ZnO, and $SiO_2$.

The invention relates to a fabric knitted or woven from the polyamide yarn as described above. The fabric according to the invention exhibits warm-keeping properties, and when measured in laboratory tests, it usually exhibits a temperature elevation higher by at least 5° C. than a reference fabric in a halogen lamp test, when compared to a fabric prepared by the same method except for adding the CC, and MO in the above amounts. The fabric according to the invention exhibits deodorizing properties, and when measured in laboratory tests it shows a deodorizing rate of at least 50%, whereas a reference fabric, made by the same method except for adding said CC, exhibits a deodorizing rate of about 0%.

The invention provides a textile article made of the above described fabric, the article exhibiting warm-maintaining, drying, and deodorizing effects on the skin of a wearer. The article may comprise underwear, outerwear, pantyhose, panties, tights, hosiery, stockings, socks, body-wear, slacks, shirts, pants, dresses, suits, sweaters, sports-wear, and sport clothes.

The invention relates to a process for manufacturing a carbon coffee-containing polyamide yarn, comprising i) providing a polyamide selected from Nylon6 and Nylon 66; ii) providing a concentrate containing polyamide (PA), coffee carbon (CC) in a concentration of from about 6% to about 10%, and metal oxides (MO) in a concentration of from 3% to 5%; iii) mixing said Nylon with said concentrate, wherein the amount of said concentrate is from about 3% to about 9% of the mass of said Nylon; and iv) spinning a yarn from the mixture obtained in step iii thereby obtaining the carbon coffee-containing polyamide yarn. Said concentrate in step ii preferably contains about 8% of CC and about 4% MO, and is preferably admixed into said Nylon in step iv in an amount of from about 4% to about 9%.

The invention relates to a process for manufacturing a polyamide fabric or a textile article, comprising i) providing a polyamide selected from Nylon6 and Nylon 66; ii) providing a concentrate containing polyamide (PA), coffee carbon (CC) in a concentration of from about 6% to about 10%, and metal oxides (MO) in a concentration of from about 3% to about 5%; iii) mixing said Nylon with said concentrate, wherein the amount of said concentrate is from about 3% to about 9% of the mass of said Nylon; iv)

spinning a yarn from the mixture obtained in step iii thereby obtaining the carbon coffee-containing polyamide yarn; and v) knitting or weaving a fabric from the coffee-containing yarn of step iv; thereby obtaining a warm-maintaining, drying, and deodorizing fabric. Said article may comprise, for example, underwear, pantyhose, socks, sport clothes, shirts, pants, and sport clothes. The article of the invention exhibits deodorizing properties, it helps to keep the physiological temperature of the wearer skin and to keep the right humidity, enabling suitable drying.

DETAILED DESCRIPTION OF THE INVENTION

It has now been found that polyamide containing about 0.5% coffee carbon powder and about 0.2% inorganic oxides enables a surprisingly efficient protection against cold, when spun and knitted into a fabric, while also enabling good skin drying and providing deodorizing effects. It was found that the above desirable effects did not compromise other properties, like mechanical properties, of the yarn and fabric. For example, prepared was a master-batch of polyamide containing 8% coffee carbon powder made from coffee husks, and 3% oxides comprising $TiO_2$, $Al_2O_3$, $ZrO_2$, ZnO, or silica; molten Nylon 66 was homogenized with the master-batch concentrate which was added in various amounts; a yarn was spun, and a fabric was knitted; and a temperature rising test was run to find that the fabric according to the invention showed a temperature elevation higher by about 10° C. than the reference fabric; the reference fabric was prepared in the same way but lacked the carbon powder and oxides.

The invention relates to a polyamide comprising carbon coffee powder prepared by carbonizing the shale of coffee beans. Preferably, said polyamide (PA) is PA66 or PA6, and said coffee carbon (CC) is homogeneously dispersed in molten PA in an amount of between 0.1% and 2.0%, preferably between 0.2% and 1.0%. All percentage values are in weight percents. Said polyamide with coffee carbon (PA/CC) preferably comprises metal oxides (MO) in an amount preferably between about 0.3% and 0.8%. The term MO as used herein comprises oxides of typical metals and silicon dioxide as well. Said polyamide with coffee carbon (PA/CC) may comprise metal oxides silicates, sulfates, carbonates or other minerals in an amount between about 0.1% and 0.5%. Said CC may be added to molten PA in the form of a concentrate, for example as CC dispersed in a polyamide like PA 6 or PA 66. Said oxides may be added in the form of the same concentrate, together with the CC. In a preferred embodiment, both the CC and the oxides are prepared as a master-batch, for example containing PA and CC in an amount of from 6% to 10%, and oxides in a half of that amount. A typical master-batch may comprise an MO mixture containing $TiO_2$, $SiO_2$ and $ZrO_2$ in an amount of from 3% to 4%, or $TiO_2$, $ZrO_2$, ZnO and $Al_2O_3$ in an amount of from 3% to 4%. The polyamide comprising the coffee carbon and the oxides (PA/CC/MO) is spun into yarns, and the yarns are knitted or woven according to the desired properties of the final textile articles.

The invention relates to a special yarn, to fabric comprising then yarn, and to apparel articles comprising said fabric, enabling maintaining the surface temperature of the wearer's skin at physiologically optimal values, whereas the wear articles are comfortable to touch and feel warm, and have deodorizing effects. The warming effects of the materials according to the invention are confirmed in objective laboratory tests, such as halogen lamp heating test. For example, a Nylon 66 yarn comprising about 0.6% CC and about 0.2% MO may be spun and knitted to an apparel, for example including pantyhose, socks, sport clothes, shirts, pants, sports underwear, exhibiting, in a heating test, a temperature elevation which is by 10° C. higher than achieved by a comparative apparel lacking the active additives.

The invention aims at providing a special yarn for knitting or weaving a nylon fabric which feels pleasant and warm on the skin of a wearer using a wear article made of said fabric. The invention, thus, relates to a manufacturing process comprising steps of i) providing Nylon, preferably Nylon 6 or Nylon 66, containing CC and MO, said MO possibly comprising Ti, Zr, Zn, Al, Si, or their combination, ii) melt spinning said Nylon, iii) knitting or weaving a fabric to be used in making apparel, thereby obtaining an apparel maintaining the skin surface temperature and humidity, while also exhibiting deodorizing effect. Said step i) may comprise mixing said Nylon with a CC+MO concentrate, for example by adding 8% of a master-batch mixture containing 8% CC and 4% MO. Said step iii) may provide apparels such as pantyhose, tights, sweaters, and underwear, sports clothes, socks, shirts, etc. Said step i) preferably comprises incorporating carbon and inorganic additives into the polymer, wherein the particle size of the inorganic additive may be from 0.1 μm to 5 μm. The total effect of the wear article according to the invention results from the structural properties of the fabric, including physical and chemical properties of the fiber affecting its heat conductivity and its sensory effects on the skin.

The articles to be made of the yarn according to the invention include, in one embodiment, underwear such as knitted leg-wear and body-wear garment, sports wear, hosiery, underwear, tights, knitwear, sweaters, slacks, suits, pantyhose, pants, shirts, socks, etc. The invention provides articles, knitted or woven of PA/CC/MO yarn, providing pleasant feeling on skin touch, supporting quick transport of the skin humidity including perspiration outside, while efficiently assisting in maintaining optimal skin temperature and in suppressing the release of the body odors to the environment by absorbing odor compounds, thus effectively having deodorizing effects; said odor compounds may be released during washing said textile article. The yarn and warming garment according to the invention, thus, help to slow down the heat transport from the body to the environment, without hindering skin drying. The ability of the fabric and articles to keep the covered surface warm, as well as the deodorizing ability, were proven in laboratory objective tests by measuring heating curves and deodorizing rates.

The invention will be further described and illustrated in the following examples.

EXAMPLES

Example 1

The heating properties of the fabrics were characterized by halogen lamp test in the laboratory of at Hua Mao Nano-Tech Co. Ltd using the following experimental conditions. The lamp source-detector distance was 50 cm, the lamp power was 500 watt. The heating-up time was 600 seconds. Lamp source angle was 35 degrees. The detector temperature, starting with the initial ambient temperature, was recorded and the temperature elevation was plotted against time. The temperature elevation of the fabric according to the invention was compared with the elevation of the reference fabric manufactured the same way, but without adding the master-batch components.

Example 2

The deodorizing properties of the fabrics were characterized at Taiwan Textile Research Institute using the following conditions. The reference volatile material used in the test was ammonia. A deodorizing textile sample 10 cm×10 cm was placed in a quartz bottle with an initial gas ammonia concentration of 100 ppm. The residual ammonia concentration in ppm (RC) was measured after 24 hours. The deodorizing rate (DR) of a sample in % was defined as $$DR=100-RC$$

A reference sample showed zero value of DR.

Example 3

The employed Nilit PA polymer had the properties shown in table 1. The employed additive master-batch, obtained from Hua Mao Nano-Tech Co. Ltd., comprised 8.4% CC, and 3.6% inorganic oxides, mainly $TiO_2$.

TABLE 1

Polymer properties

| | | Nilit B40 |
|---|---|---|
| Relative viscosity | RV | 40.5 |
| Amine end groups | Meq/Kg | 44.6 |
| $TiO_2$ content | % | 0.03 |
| Humidity | Ppm | 1150 |

Bright polyamide 66 man manufactured in NILIT was mixed with the master-batch (concentrate) above in an amount of 8.2% (according to the invention) or was used without mixing with said concentrate (reference of comparative sample). Spinning on POY pilot machine consisted mainly of extruder 3E10/24S made by BARMAG, screw diameter 38 mm. spinning beam with 4 packs to adapt 64 mm diameter spinneret and BARMAG CW 900/6 winder. The POY yarn spun to titer of 55/34 and then textured on SCRAGG DCS 1200 pilot machine to both 44/34/1 and 44/34/2. The yarns are either 1 ply (44/34/1) with twist direction S or Z, or 2 ply (44/34/2) where 2 end S and Z are combined together on the texturing machine, providing a total titer of 88 dtex and total number of filaments of 68. The spinning parameters are in Tables 2. The yarn was textured on false twist texturing machine in two modifications, as shown in Tables 3 and 4, relating to 44/34/1 and 44/34/2 respectively. Samples with carbon coffee and samples without carbon coffee are described, dyed and non dyed. Samples with the carbon coffee yield higher temperature effects.

Knitted cloth samples, including coffee carbon yarn (PA/CC/MO) and reference yarn (PA), either without or with dyeing, were tested for heating properties and for deodorizing properties as explained in Examples 1 and 2. The final temperature values after 600 seconds for four cloth samples were as follows:

PA/CC/MO without dyeing: 65° C.

PA without dyeing: 53° C.

PA/CC/MO with dyeing: 62° C.

PA with dyeing: 55° C.

TABLE 2

Spinning parameters and POY properties for the sample according to the invention and the comparative sample

| | | Coffee carbon 55/34 | 55/34 regular B40 |
|---|---|---|---|
| Melt temperature | ° C. | 284 | 284 |
| Extruder outlet pressure | Bar | 100 | 100 |
| Spinneret initial pressure | Bar | 150 | 150 |
| Winding speed | m/min | 4500 | 4500 |
| Titer | Dtex | 57.4 | 57.6 |
| Elongation | % | 63.6 | 75.9 |
| Tenacity | cN/dtex | 3.26 | 3.84 |

TABLE 3

Conditions and single ply textured yarn properties

| | | 44/34/1 coffee carbon yarn | 44/34/1 B40 |
|---|---|---|---|
| Winding speed | m/min | 683 | 683 |
| Draw ratio | | 1.286 | 1.286 |
| D/Y ratio | | 2.14 | 2.14 |
| Disk configuration | | 1-7-1 | 1-7-1 |
| Heater temperature | ° C. | 215 | 215 |
| Titer | Dtex | 45.4 | 45.4 |
| Tenacity | cN/dtex | 3.75 | 3.85 |
| Elongation | % | 21.1 | 22.6 |
| Crimp Contraction | % | 45.6 | 44.3 |
| Crimp Modulus | % | 19.6 | 18.3 |
| Crimp Stability | % | 90.5 | 89.8 |

TABLE 4

Conditions and 2 ply textured yarn properties

| | | 44/34/2 coffee carbon yarn | 44/34/2 B40 |
|---|---|---|---|
| Winding speed | m/min | 683 | 683 |
| Draw ratio | | 1.286 | 1.286 |
| D/Y ratio | | 2.14 | 2.14 |
| Disk configuration | | 1-7-1 | 1-7-1 |
| Heater temperature | ° C. | 215 | 215 |
| Titer | Dtex | 91.4 | 92.2 |
| Tenacity | cN/dtex | 3.98 | 3.88 |
| Elongation | % | 22.8 | 24.2 |
| Crimp Contraction | % | 40.8 | 41.2 |
| Crimp Modulus | % | 17.3 | 17.9 |
| Crimp Stability | % | 86.8 | 86.7 |

Thus, a fabric according to the invention exhibited a temperature elevation higher by 12° C. and by 7° C., respectively, than a reference fabric, when checking two types of cloth. As for the deodorizing rate, it was measured for the sample after dyeing, and was found to be 85% for the fabric according to the invention and 0% for the reference sample.

Example 4

The same PA polymer and the same additive master-batch as employed in Example 3 were used, but Bright polyamide 66 was mixed with the master-batch in an amount of 4.5% (according to the invention) or was used without the additive (comparative). The process is characterized in the following tables.

TABLE 5

Spinning parameters and POY yarn properties for the sample according to the invention and the comparative sample

| | | Coffee carbon 55/34 | 55/34 regular B40 |
|---|---|---|---|
| Melt temperature | ° C. | 284 | 284 |
| Extruder outlet pressure | Bar | 100 | 100 |
| Spinneret initial pressure | Bar | 150 | 150 |
| Winding speed | m/min | 4500 | 4500 |
| Titer | dtex | 57.5 | 57.6 |
| Elongation | % | 66.2 | 79.8 |
| Tenacity | cN/dtex | 3.29 | 3.64 |

TABLE 6

Conditions and single ply textured yarn properties

| | | 44/34/1 coffee carbon yarn | 44/34/1 B40 |
|---|---|---|---|
| Winding speed | m/min | 683 | 683 |
| Draw ratio | | 1.286 | 1.286 |
| D/Y ratio | | 2.14 | 2.14 |
| Disk configuration | | 1-7-1 | 1-7-1 |
| Heater temperature | ° C. | 215 | 215 |
| Titer | dtex | 45.8 | 45.6 |
| Tenacity | cN/dtex | 3.92 | 3.93 |
| Elongation | % | 24.3 | 23.8 |
| Crimp Contraction | % | 44.5 | 45.8 |
| Crimp Modulus | % | 18.3 | 19.3 |
| Crimp Stability | % | 86.7 | 87.9 |

TABLE 7

Conditions and 2 ply textured yarn properties

| | | 44/34/2 coffee carbon yarn | 44/34/2 B40 |
|---|---|---|---|
| Winding speed | m/min | 683 | 683 |
| Draw ratio | | 1.286 | 1.286 |
| D/Y ratio | | 2.14 | 2.14 |
| Disk configuration | | 1-7-1 | 1-7-1 |
| Heater temperature | ° C. | 215 | 215 |
| Titer | Dtex | 91.2 | 90.9 |
| Tenacity | cN/dtex | 3.94 | 3.94 |
| Elongation | % | 25.1 | 24.6 |
| Crimp Contraction | % | 41.4 | 42.5 |
| Crimp Modulus | % | 46.6 | 17.0 |
| Crimp Stability | % | 82.9 | 84.3 |

Knitted cloth samples, including coffee carbon yarn (PA/CC/MO) and reference yarn (PA), both dyed black, were tested for heating properties and for deodorizing properties as explained in Examples 1 and 2. The final temperature values after 600 seconds for four cloth samples were as follows:

PA/CC/MO dyed black: 50° C.

PA dyed black: 43° C.

Thus, a fabric according to the invention exhibited a temperature elevation higher by 7° C. than a reference fabric.

Example 5

Sleeves were knitted of fabrics as described in Example 3, comprising the coffee carbon yarn of the invention without dyeing, with dyeing, and reference yarn. The sleeves were washed in 50 cycles and their heating properties were rechecked. The values remained practically unchanged.

While this invention has been described in terms of some specific examples, many modifications and variations are possible. It is therefore understood that within the scope of the appended claims, the invention may be realized otherwise than as specifically described.

The invention claimed is:

1. A yarn for manufacturing a fabric with warm-maintaining and deodorizing properties, the yarn consisting of:

i) polyamide (PA);

ii) coffee carbon powder (CC) in an amount between 0.3% and 0.8% by weight of the yarn; and iii) an inorganic additive in an amount between 0.05% and 0.5% by weight of the yarn; wherein said PA is Nylon 66, said CC originates from coffee husks, and said inorganic additive is a metal oxide (MO) selected from the group consisting of: $TiO_2$, $Al_2O_3$, $ZrO_2$, ZnO, $SiO_2$, and combinations thereof, wherein said CC and said MO are homogeneously dispersed in said Nylon 66 in molten state; and wherein said fabric exhibits (a) a temperature elevation higher by at least 5° C. when compared with a reference fabric which is prepared by the same method as said fabric with warm-maintaining and deodorizing properties except for the absence of said CC and MO in a halogen lamp test employing a 500 watt halogen lamp at a distance of 50 cm from the fabric while measuring and recording the temperature increase for 600 seconds, starting from initial ambient temperature, and (b) a deodorizing rate of at least 50% in the ammonia test characterizing the relative decrease of residual ammonia concentration from initial gas ammonia concentration of 100 ppm in a closed bottle with the fabric after 24 hours.

2. A yarn according to claim 1, wherein said MO is in an amount between 0.05% and 0.25% by weight of said yarn.

3. A yarn according to claim 1, wherein said MO is at least three inorganic additives selected from $TiO_2$, $Al_2O_3$, $ZrO_2$, ZnO, and $SiO_2$.

4. A fabric knitted or woven from a polyamide yarn according to claim 1, exhibiting (a) a temperature elevation higher by at least 5° C. than a reference fabric in a halogen lamp test, and (b) a deodorizing rate of at least 50% in the ammonia test.

5. A textile article comprising a fabric according to claim 4, selected from underwear, outerwear, pantyhose, panties, tights, hosiery, stockings, socks, body-wear, slacks, shirts, pants, dresses, suits, sweaters, sports-wear, and sport clothes.

6. A textile article according to claim 5, exhibiting warm-maintaining, drying, and deodorizing effects on the skin of a wearer.

7. A textile article according to claim 5, exhibiting deodorizing properties, and assisting in keeping the physiological temperature of the wearer skin and in drying said skin.

8. A process for manufacturing a textile article according to claim 5, comprising:

i) providing Nylon 66;

ii) providing a concentrate containing PA, CC in a concentration of from 6% to 10%, and MO in a concentration of from 3% to 5%;

iii) mixing said Nylon with said concentrate, wherein the amount of said concentrate is from 3% to 9% of the mass of said Nylon;

iv) spinning a yarn from the mixture obtained in step iii) thereby obtaining the coffee carbon-containing polyamide yarn; and v) knitting or weaving a fabric from the coffee carbon-containing yarn of step iv); thereby obtaining a warm-maintaining, drying, and deodorizing fabric.

9. A process for manufacturing a polyamide fabric according to claim 4, comprising i) providing Nylon 66;

ii) providing a concentrate containing PA, CC in a concentration of from 6% to 10%, and MO in a concentration of from 3% to 5%;

iii) mixing said Nylon with said concentrate, wherein the amount of said concentrate is from 3% to 9% of the mass of said Nylon;

iv) spinning a yarn from the mixture obtained in step iii) thereby obtaining the coffee carbon-containing polyamide yarn; and v) knitting or weaving a fabric from the coffee carbon-containing yarn of step iv); thereby obtaining a warm-maintaining, drying, and deodorizing fabric.

10. A process for manufacturing a coffee carbon-containing polyamide yarn according to claim 1, comprising:

i) providing Nylon 66;

ii) providing a concentrate containing said PA, said CC in a concentration of from 6% to 10%, and said MO in a concentration of from 3% to 5%;

iii) melting said Nylon and mixing it with said concentrate, thereby homogeneously dispersing said CC and said MO in the molten Nylon, wherein the amount of said concentrate is from 3% to 9% of the mass of said Nylon; and iv) spinning a yarn from the mixture obtained in step iii) thereby obtaining the carbon coffee-containing polyamide yarn.

11. A process according to claim 10, wherein said concentrate in step ii) contains about 8% of CC and about 4% MO, and wherein said concentrate in step iii) is admixed into said Nylon in an amount of from 4% to 8% of the mass of said Nylon.

12. A textile article obtained from the yarn of claim 1, selected from underwear, outerwear, pantyhose, panties, tights, hosiery, stockings, socks, body-wear, slacks, shirts, pants, dresses, suits, sweaters, sports-wear, and sport clothes.

* * * * *